United States Patent [19]

Stillwagon et al.

[11] Patent Number: 5,054,615

[45] Date of Patent: Oct. 8, 1991

[54] HOT WORK ORGANIZER

[76] Inventors: Ross I. Stillwagon, 12741 Los Nietos Rd., Santa Fe Springs; Fernando Fischbach, 8363 Dinsdale St., Downey; Jon F. Linscott, 12741 Los Nietos Rd., Santa Fe Springs, all of Calif. 90670

[21] Appl. No.: 635,244

[22] Filed: Dec. 28, 1990

[51] Int. Cl.[5] ..... B65D 85/20

[52] U.S. Cl. ..... 206/373; 211/70.6

[58] Field of Search ..... 206/320, 349, 372, 373; 211/70.6

[56] References Cited

U.S. PATENT DOCUMENTS

| | | | |
|---|---|---|---|
| 2,529,372 | 11/1950 | Burns | 211/70.6 |
| 2,572,797 | 10/1951 | Zimmer | 211/70.6 |
| 4,140,256 | 2/1979 | King | 206/373 |
| 4,416,372 | 11/1983 | Polk | 206/372 |
| 4,570,792 | 2/1986 | Conway | 206/349 |
| 4,819,800 | 4/1989 | Wilson | 206/373 |

*Primary Examiner*—Jimmy G. Foster

*Attorney, Agent, or Firm*—Ronald L. Juniper

[57] ABSTRACT

This is an organizer and holder for hair styling irons and a heater stove sized and balanced to conveniently fit in an ordinary stylist work station.

It includes a series of tubular receptacles (for holding hair irons) supported by a rigid, curved, band-shaped strap rising from a supporting base.

The base has means to secure a heater stove in place and has a utility tray for holding a working iron.

9 Claims, 4 Drawing Sheets

HOT WORK ORGANIZER

BACKGROUND OF THE INVENTION

The invention relates to a special apparatus engineered to uniquely organize and hold equipment used by those who style hair with hot irons.

A busy hairstylist has a need to have a multitude of hot curling irons and a heater readily at hand as work is being done. The normal work station space is quite small.

Prior to this invention a stylist working with hot irons would have to lay them on wet cloth on counters, often causing the counters to be damaged by burning accidents. Working tools were kept inside drawers which were often very disorganized and difficult to find quickly when needed.

Such haphazard arrangements of working tools jeopardized the safety and efficiency of the stylist. Getting burned was a constant potential problem for a stylist. In addition, a heater for the irons often attained temperatures to 600 degrees F. so that it had to be put in a safe, but convenient, place.

SUMMARY OF THE INVENTION

Accordingly, to solve these and other problems the Perfect 10 plus 2 Organizer has been created by this invention. The 10 plus 2 refers to the fact that 10 is a conventional number of curling irons used by a hair stylist and 2 is a conventional number of pressing combs.

This organizer includes a base from which a rigid, band-shaped strap curves back and upwardly raised from one side of the base to the other.

A number of cylindrical receptacles are attached in series around the raised part of the strap shape and sized to hold hair curling irons. The base is provided with means to hold a heater in place thereon and a utility tray to an iron which is being used.

DETAILED DESCRIPTION OF A PREFERRED FORM OF THE INVENTION

Figure 1:
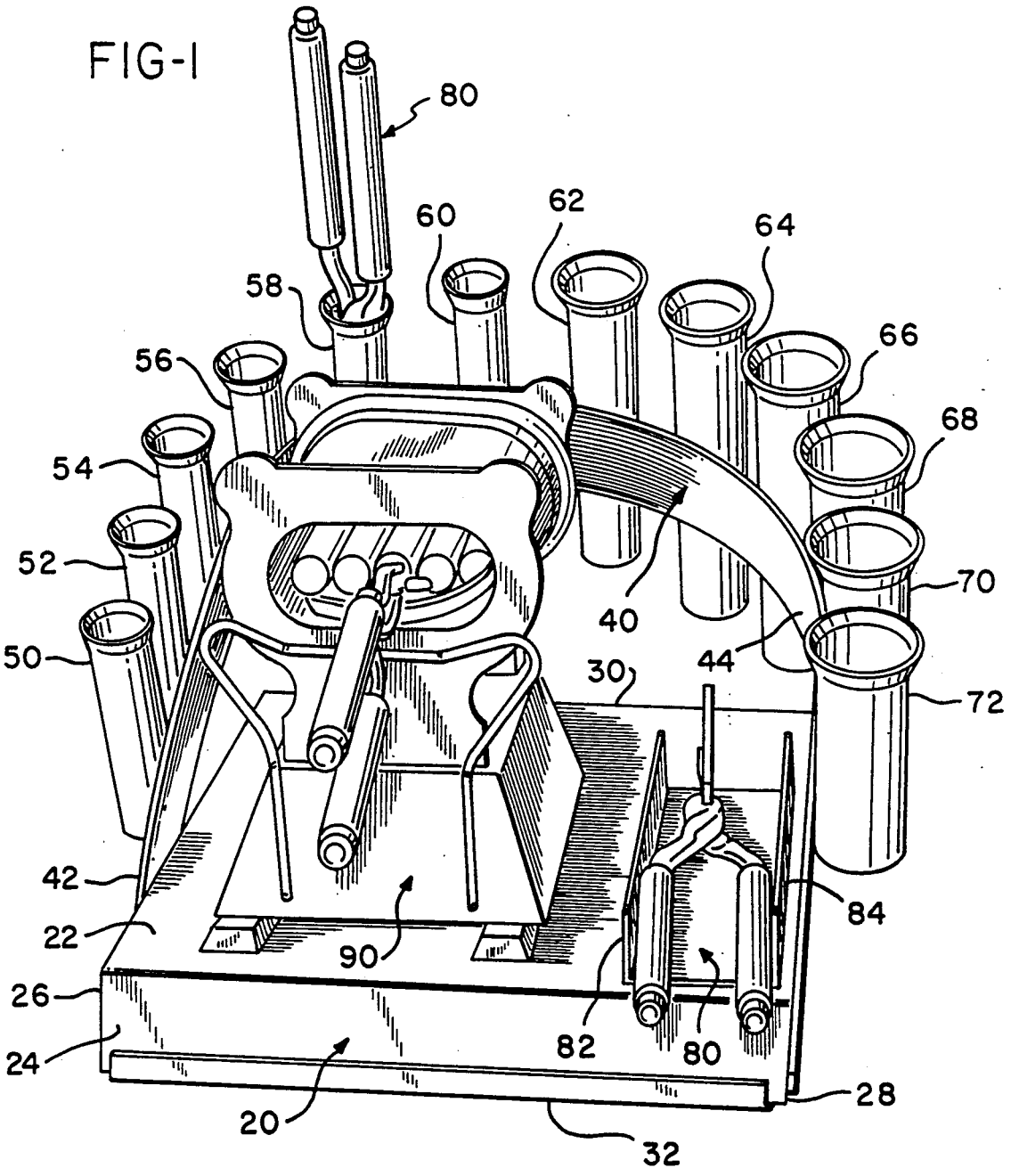
FIG. 1 is an isometric view of this invention taken from a frontal, slightly upper right angle showing the apparatus in use with a heater stove in place with curling irons thereon, an iron mounted in a tubular receptacle and another iron held in a utility tray mounted on the device.
Figure 2:
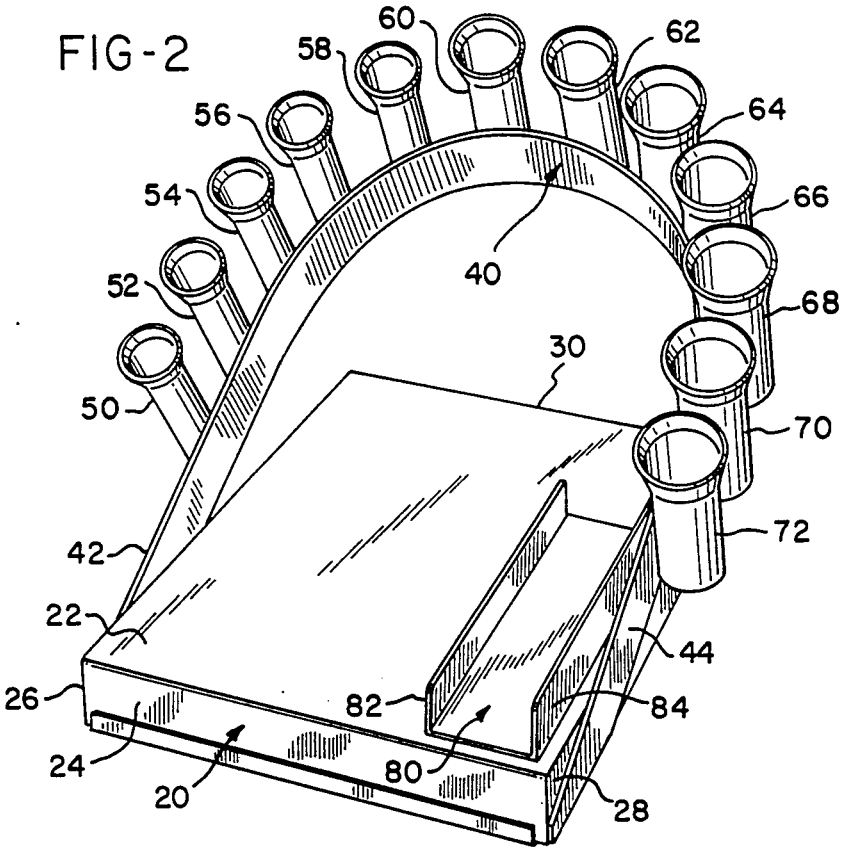
FIG. 2 is a perspective view of the invention taken from a point angled from the upper right thereof.
Figure 3:
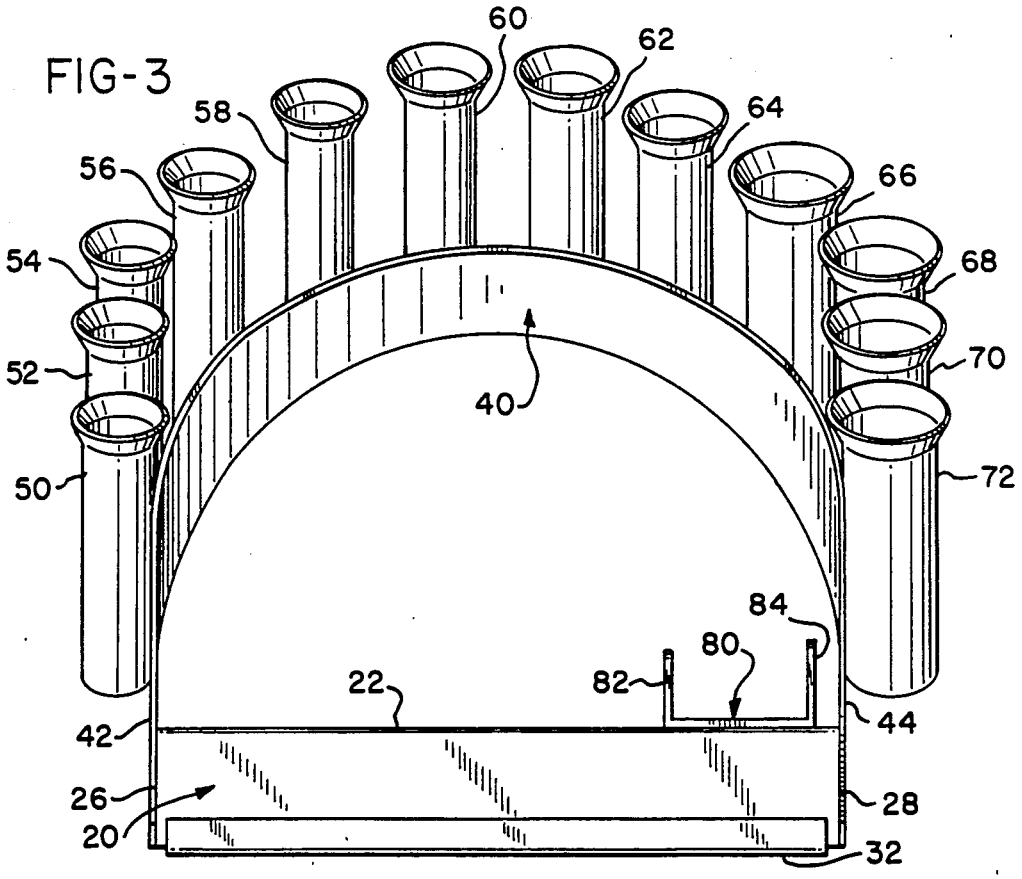
FIG. 3 is a front elevational view of the invention as shown in FIG. 1.
Figure 4:
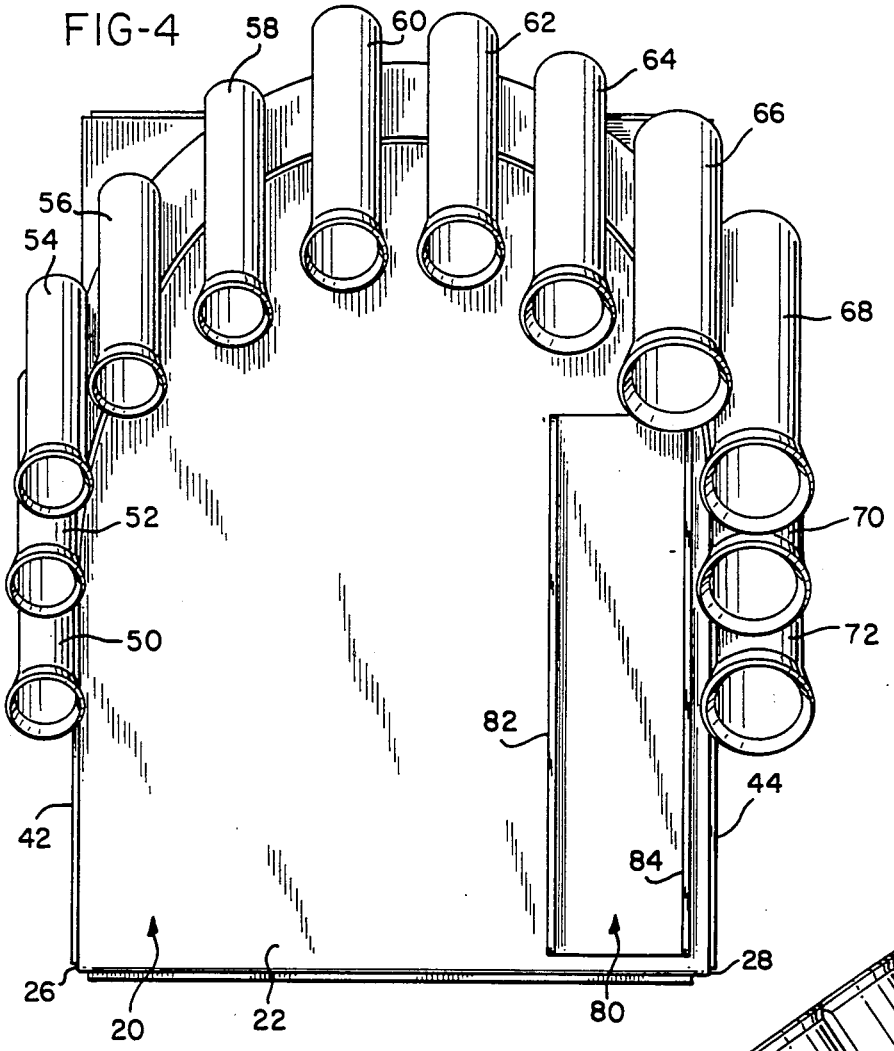
FIG. 4 is a top plan view of the invention as shown in FIG. 3.

As shown in the drawings this invention includes a four-sided base 20 which is formed with a flat top 22, front 24, left side 26, right side 28, back 30 and flat bottom 32.

A curved, rigid, bandshaped strap 40, extending back and upwardly raised from base 20 is supported by its left end 42 secured to the left side 26 of base 20 and its right end 44 secured to the right side 28 of base 20.

Figure 5:
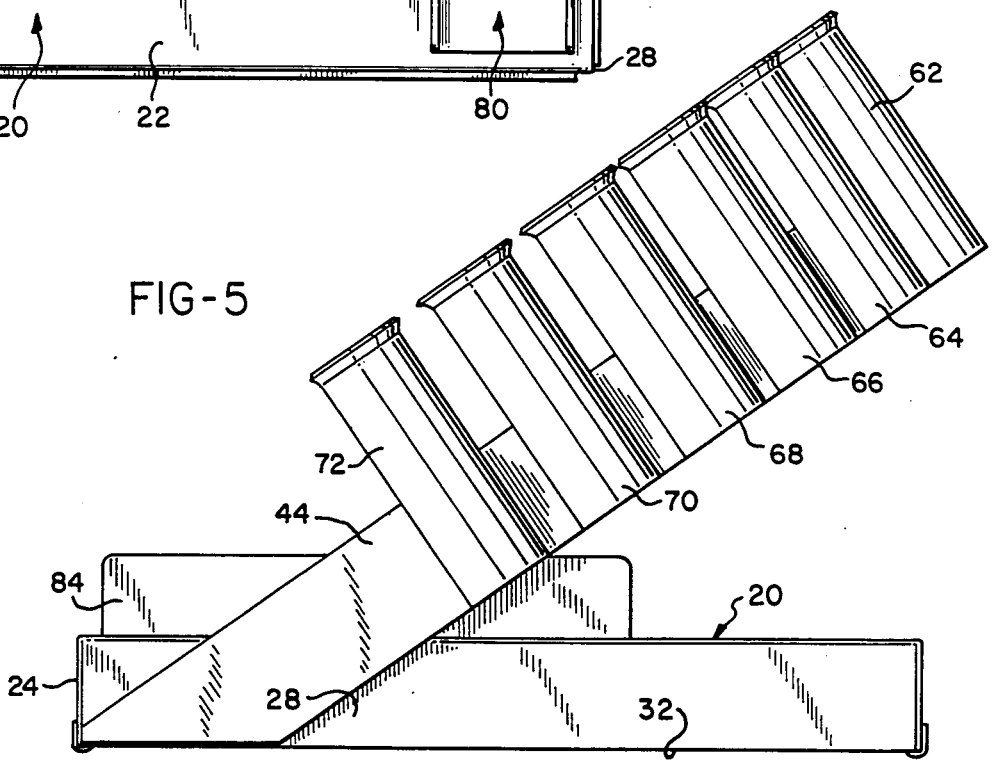
FIG. 5 is a right side elevational view of the invention as shown in FIG. 3.
Figure 6:
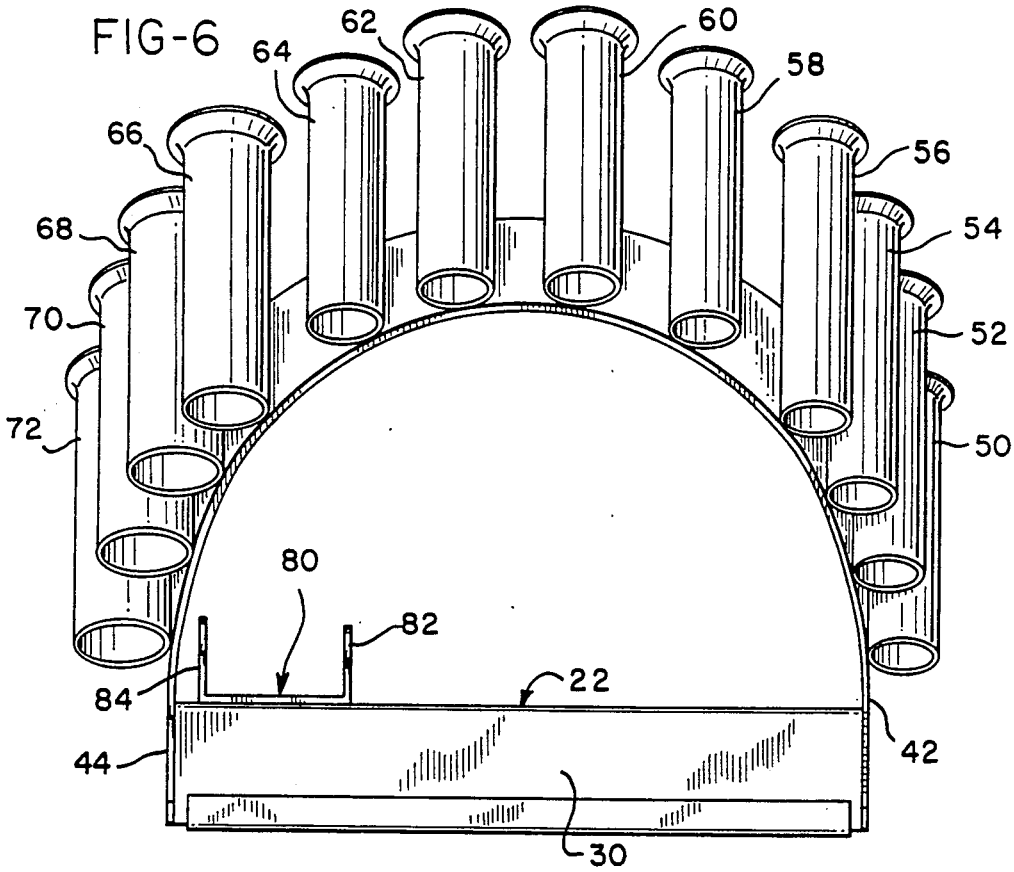
FIG. 6 is a rear elevational view of the invention as shown in FIG. 3.
Figure 7:
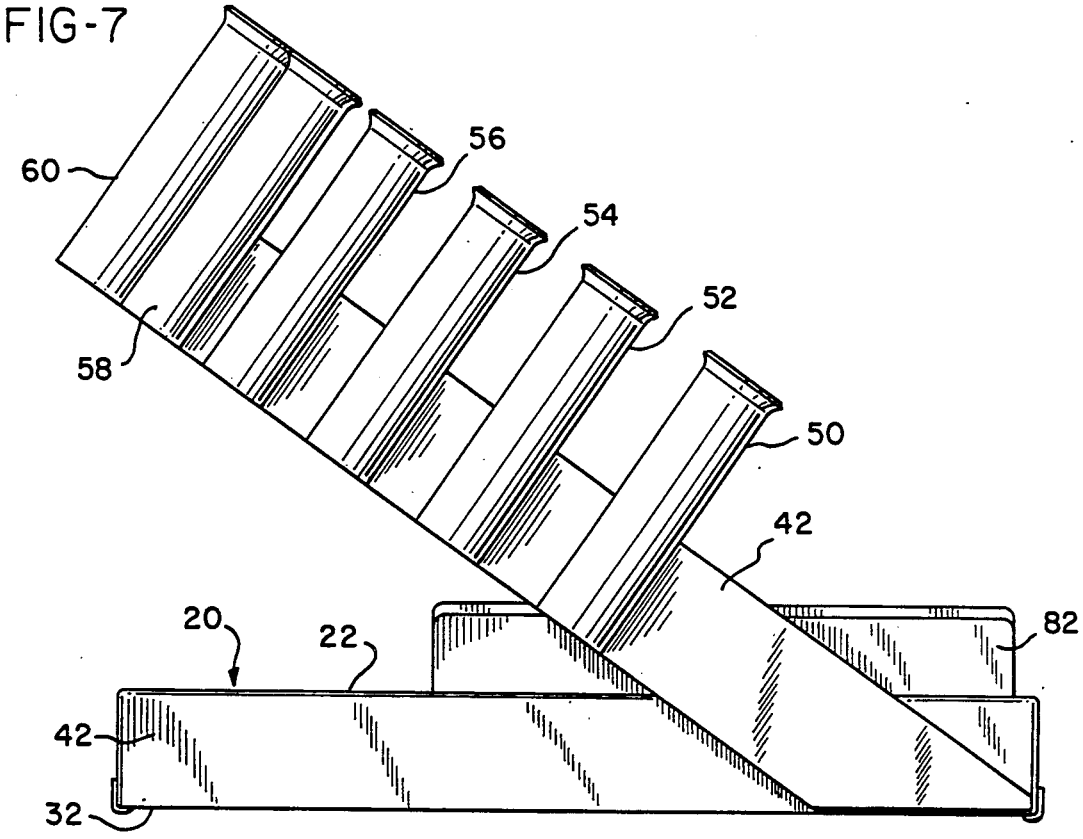
FIG. 7 is a left side elevational view of the invention as shown in FIG. 3.

The strap 40 extends back from sides 26 and 28 of base 20 and slightly behind the back 30 thereof as best seen in FIG. 5 and 7.

The strap 40 is stategically located relative to base 20 to provide a low center of gravity which provides stability to the stand and prevents tip-overs.

Thus, the angle of attachment of the strap 40 at sides 26 and 28 relative to base 20 is approximately 30 degrees plus or minus 5 degrees. The holder tubes are attached to strap 40 with longitudinal axes aligned with strap 40.

This angle of the tube support is specifically calculated to provide maximum dissipation of heat and ease of iron removal from thhe holders. The hot irons are held by the holder tubes so that it is virtually impossible for them to fall out and burn an operator because their critically angled support. In operation, a typical apparatus is compactly sized to fit an ordinary work station. Thus, its base 20 has a nine inch front 24, sides 26 and 28 about 12 inches deep and the holders carried by strap 40 rise to a height of about 10 and ½ inches above the bottom 32 of base 20.

The curling iron holders are tubes made of 18 gauge (0.049") cold rolled steel for appropriate structural utility and smooth surface finish. The angle of flare on the top entry portion of the holder tubes is about 30 plus or minus 5 degrees. This allows for easy ingress and egress of irons placed therein.

The strap 40 is made of 16 gauge (0.065") cold rolled steel which provides sufficient rigidity to support the holders attached thereto, with a full load of irons, but flexible enough not to cause damage if impacted.

Attached around the outer periphery of the strap 40 are a series of cylindrically-shaped curling iron receptacle holders 50,52,54,56,58,60,62,64,66,68,70 and 72. These holders are suspended above the base 22 and preferably are angled somewhat towards the front 22 of base 20 as best shown in FIGS. 5 and 7. That is, the longitudinal axes of the holders are angled relative to the bottom horizontal plane of the base 20.

The holders are shaped to hold a variety of different sizes of curling irons, such as 80, shown in FIG. 1, wherein the curling iron 80 has its curling iron portion inserted into holder 58 with the handle portion projecting above the holder. Because of the angled displacement of the holder the heat from a hot iron placed therein will not directly escape upwardly to make the handle hot. The angling also makes the held irons more convenient to grasp.

The holder tubes carried by strap 40 are spaced from each a sufficient distance that iron handles held therein can be easily grasped and retrieved.

The utility tray 80 is a channel made of 20 gauge (0.38") cold rolled steel for structural value and smooth surface finish. It is strategically located to provide the operation with easy access to a working iron placed therein.

The base 20 is made of 20 gauge cold rolled steel (0.038 inches thick) which is designed to dissipate heat and prevent a hot oven placed thereon from damaging the working station or the handles of curling irons.

The holders preferably have outwardly flared top entry openings, open bottom ends and are arranged in a sequentially ascending diameter sized series extending from one side of strap 40 to the other so as to mate with and hold varying diameter curling irons (not shown).

When a particular curling iron is selected for use a working station utility tray 80, with spaced parallel side walls 82 and 84 mounted on base 20 provides a convenient place to rest the working curling iron.

Means to securely hold a removable heater stove 90 in place on top of base 20 are provided by rubber bumpers 92 and 94 (mounted on the top of base 20) which are spaces apart just sufficiently enough to tightly lodge heater stove 90 when placed therein.

What is claimed is:

1. A hot work organizer including:

a base;

a supporting band mounted on said base and extending upwardly therefrom; and a plurality of curling iron holders carried by said band positioned above and toward the rear of said base, said holders adapted to recieve a variety of different size curling irons having handle and heating iron portions at the opposite ends thereof.

2. An organizer as defined in claim 1 wherein said band is an upwardly curving strap.

3. An organizer as defined in claim 2 wherein said holders are angled relative to the resting position of said base so that curling irons held therein have their handles displaced vertically from being over their heating iron portions so as to avoid transferring heat from said heating iron portion to said handle portion.

4. An organizer as defined in claim 1 wherein said curling iron holders are tubular in shape.

5. An organizer as defined in claim 4 wherein said holders have outwardly flared upper entry openings.

6. An organizer as defined in claim 1 wherein said base is a plate having opposite sides and has means to securely hold an iron heater stove thereon.

7. An organizer as defined in claim 6 wherein said supporting band is an upwardly curved strap extending between the opposite sides of said base.

8. An organizer as defined in claim 7 wherein said supporting band carries said curling iron holders at an angle relative to said base such that an iron held therein has its hot iron end portion displaced sufficiently from being directly beneath said handle end portion that a user grasping said handle will not burn her hand because heat which might rise from said hot iron end portion.

9. An organizer as defined in claim 8 wherein said angled position of said holders is about thirty degrees.

* * * * *

US005054615B1

REEXAMINATION CERTIFICATE (3112th)

United States Patent [19] [11] B1 5,054,615

Stillwagon et al. [45] Certificate Issued *Jan. 28, 1997

[54] HOT WORK ORGANIZER

[76] Inventors: Ross I. Stillwagon, 12741 Los Nietos Rd., Santa Fe Springs; Fernando Fischbach, 8363 Dinsdale St., Downey; Jon F. Linscott, 12741 Los Nietos Rd., Santa Fe Springs, all of Calif. 90670

[ * ] Notice: The term of this patent shall not extend beyond the expiration date of Pat. No. D. 342,585.

Reexamination Request:
No. 90/003,837, May 18, 1995

Reexamination Certificate for:

| | |
|---|---|
| Patent No.: | **5,054,615** |
| Issued: | **Oct. 8, 1991** |
| Appl. No.: | **635,244** |
| Filed: | **Dec. 28, 1990** |

[51] Int. Cl.[6] ..... B65D 85/20
[52] U.S. Cl. ..... 206/373; 211/70.6
[58] Field of Search ..... 206/320, 349, 206/372, 373, 443; 211/60.1, 69.5; 219/222, 223, 225; 248/117.2–117.6, 146, 154

[56] References Cited

U.S. PATENT DOCUMENTS

| | | | |
|---|---|---|---|
| D. 217,789 | 6/1970 | Oddo | D74/5 |
| D. 243,559 | 3/1977 | Hoyle et al. | D28/38 |
| D. 314,067 | 1/1991 | Ward | D28/38 |
| D. 342,585 | 12/1993 | Fischbach et al. | D28/38 |
| 1,662,077 | 12/1927 | Schwartz | 211/13 |
| 1,738,845 | 12/1929 | Rollman | 248/117.3 |
| 2,529,372 | 11/1950 | Burns | 211/89 |
| 2,572,797 | 10/1951 | Zimmer et al. | 211/87 |
| 3,215,815 | 11/1965 | Lerner | 248/176 X |
| 3,964,708 | 6/1976 | Reeves | 248/126 |
| 4,068,760 | 1/1978 | Johnson | 211/74 |
| 4,140,256 | 2/1979 | King | 224/48 W |
| 4,219,035 | 8/1980 | Deconinck | 132/84 D |
| 4,412,618 | 11/1983 | La Conte | 206/581 |
| 4,416,372 | 11/1983 | Polk | 206/372 |
| 4,446,972 | 5/1984 | Sussman | 211/13 |
| 4,570,792 | 2/1986 | Conway | 206/349 |
| 4,819,800 | 4/1989 | Wilson | 206/373 |
| 4,907,705 | 3/1990 | Waldeck | 211/13 |
| 5,031,778 | 7/1991 | Edgecombe | 211/13 |

OTHER PUBLICATIONS

*Webster's Collegiate Dictionary*, 1979, p. 86.

*Primary Examiner*—Jimmy G. Foster

[57] ABSTRACT

This is an organizer and holder for hair styling irons and a heater stove sized and balanced to conveniently fit in an ordinary stylist work station.

It includes a series of tubular receptacles (for holding hair irons) supported by a rigid, curved, band-shaped strap rising from a supporting base.

The base has means to secure a heater stove in place and has a utility tray for holding a working iron.

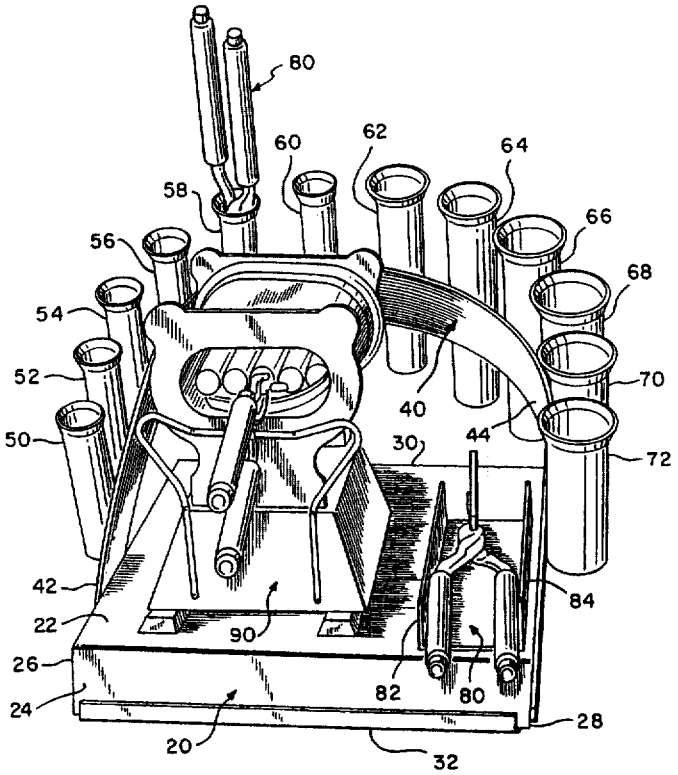

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 6 are determined to be patentable as amended.

Claims 3–5 and 7–9, dependent on an amended claim, are determined to be patentable.

1. A hot work organizer including:

a base *having front and rear portions of a top surface thereof*;

a supporting [band] *strip* mounted on said base and extending upwardly therefrom, *said supporting strip having an arcuately directed portion extending over and around the rear portion of said base top surface for providing access to the front portion of said base top surface*; and a plurality of curling iron holders carried by said [band] *strip* positioned above and toward the rear of said base, said holders adapted to receive a variety of different size curling irons having handle and heating iron portions at the opposite ends thereof.

2. [An] *A hot work* organizer [as defined in claim 1 wherein] *including:*

*a base;*

*a supporting band mounted on said base and extending upwardly therefrom,* said band [is] *being* an upwardly curving strap *extending at least partially around said base; and,*

*a plurality of curling iron holders carried by said band positioned above and toward the rear of said base, said holders adapted to receive a variety of different size curling irons having handle and heating iron portions at the opposite ends thereof.*

6. An organizer as defined in claim [1] *2* wherein said base is a plate having opposite sides and has means [to] *mounted on a frontal portion of a top surface of said base for* securely [hold] *holding* an iron heater stove thereon.

* * * * *